US007535802B2

(12) United States Patent
Pellaton

(10) Patent No.: US 7,535,802 B2
(45) Date of Patent: May 19, 2009

(54) ANNUAL CALENDAR MECHANISM FOR A TIMEPIECE

(75) Inventor: Loïc Pellaton, Neuchâtel (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 0 days.

(21) Appl. No.: 11/923,337

(22) Filed: Oct. 24, 2007

(65) Prior Publication Data

US 2008/0094941 A1 Apr. 24, 2008

(30) Foreign Application Priority Data

Oct. 24, 2006 (EP) ..... 06122850

(51) Int. Cl.
*G04B 19/20* (2006.01)
*G04B 19/24* (2006.01)

(52) U.S. Cl. ..... 368/28; 368/37

(58) Field of Classification Search ..... 368/28, 368/35–38

See application file for complete search history.

(56) References Cited

U.S. PATENT DOCUMENTS

| | | | | |
|---|---|---|---|---|
| 3,750,385 | A * | 8/1973 | Kocher | 368/35 |
| 4,228,644 | A * | 10/1980 | Watanabe et al. | 368/28 |
| 5,432,759 | A * | 7/1995 | Vaucher | 368/28 |
| 5,699,321 | A * | 12/1997 | Vaucher | 368/37 |
| 6,108,278 | A * | 8/2000 | Rochat | 368/28 |
| 7,184,369 | B2 * | 2/2007 | Crettex | 368/28 |
| 7,242,640 | B2 * | 7/2007 | Fleury | 368/38 |
| 7,301,854 | B2 * | 11/2007 | Ruefenacht | 368/37 |

FOREIGN PATENT DOCUMENTS

| | | | |
|---|---|---|---|
| EP | 1251412 | A1 | 10/2002 |
| EP | 1666991 | A1 | 6/2006 |

OTHER PUBLICATIONS

European Search Report issued in corresponding application No. EP 06 12 2850, completed Jun. 29, 2007.

* cited by examiner

*Primary Examiner*—Vit W Miska
(74) *Attorney, Agent, or Firm*—Griffin & Szipl, P.C.

(57) ABSTRACT

The invention concerns an annual calendar mechanism, including:

a date ring including a lug and 31 teeth, and a date wheel set arranged for rotating the date ring through one step per day, an intermediate wheel set cooperating with the lug such that the date wheel set drives the intermediate wheel set through a first step when the date passes from the $30^{th}$ to the $31^{st}$ of the month, via the date ring, an annual wheel set meshed with the intermediate wheel set and cooperating with the date wheel set, the date, intermediate and annual wheel sets being arranged such that the date wheel set drives the intermediate wheel set through a second step when the date passes from the $31^{st}$ to the $1^{st}$ of the month, for the months of 31 days, via the date ring, and such that the date wheel set drives the intermediate wheel set through a second step after the date has passed from the $30^{th}$ to the $31^{st}$ of the month, for the months of less than 31 days, via the annual wheel set, the intermediate wheel set then driving the date wheel ring.

The mechanism further includes a month indicator ring cooperating with the intermediate wheel set, the intermediate wheel set being arranged for rotating the month ring at least to the second step.

7 Claims, 8 Drawing Sheets

3h00

23h55

23h55

1h30

3h00

23h55

ANNUAL CALENDAR MECHANISM FOR A TIMEPIECE

This application claims priority from European Patent Application No. 06122850.8, filed Oct. 24, 2006, the entire disclosure of which is incorporated herein by reference.

FIELD OF THE INVENTION

The present invention relates to the field of horology. It concerns more specifically, an annual calendar mechanism to be fitted to a mechanical or electromechanical watch.

BACKGROUND OF THE INVENTION

Such mechanisms are known to those skilled in the art. They enable the date to pass from the $31^{st}$ to the $1^{st}$ of the month, for months of 31 days, and from the $30^{th}$ to the $1^{st}$ of the month for months of less than 31 days. They conventionally comprise a date ring fitted with 31 teeth, actuated once per day and per step, by a date wheel set. They are also generally fitted with an additional mechanism for actuating said date ring a second time upon the passage from the $30^{th}$ to the $31^{st}$ of the month, for months of less than 31 days.

This type of calendar mechanism is disclosed in EP Patent Application No. 04028561.1. It includes an annual wheel set and an intermediate wheel set, forming with the date ring and the date wheel set two kinematic chains whose origin is the date wheel set. The annual wheel set is formed of a wheel and a plate comprising 5 lugs corresponding to the 5 months of less than 31 days. The intermediate wheel set is formed of a first wheel cooperating in a two step cycle with a lug located on the date ring, and a second wheel cooperating with the wheel of the annual wheel set. The date wheel drives the date ring once per day using a first beak that comes into contact with one of the 31 teeth thereof. When the date passes from the $30^{th}$ to $31^{st}$, the lug located on the date ring meshes with the intermediate wheel set and drives the latter through one step. The intermediate wheel set then itself drives the annual wheel set through a first step. When the month in progress is a month of 30 days, one of the five lugs located on the plate of the annual wheel set appears on the trajectory of a second beak of the date wheel. The latter drives the annual wheel set through a second step, which itself drives the intermediate wheel set through a second step. The latter then drives the date ring through one step, via its lug. The date passes from the $31^{st}$ to the $1^{st}$ and the lug is released. When the month in progress is a month of the 31 days, no lug appears in contact with the beak of the date wheel. The date wheel completes one revolution prior to driving the date ring normally for the date to pass from the $31^{st}$ to the $1^{st}$. The lug of the date ring drives the intermediate wheel set through a second step, which itself drives the annual wheel set through a second step. The lug is released.

SUMMARY OF THE INVENTION

The mechanism thereby described has two embodiments. In a first variant, a month indicator disc is secured to the annual wheel set. Since the latter rotates a first time when the date passes from the 30th to the $31^{st}$ and a second time when the date passes from the $31^{st}$ to the $1^{st}$, each month appears twice on the month indicator disc, and occupies an angular sector of one $24^{th}$ of a revolution. The month display is, consequently, relative small. In a second embodiment, a month indicator disc is secured to a star wheel mounted to rotate freely on the month wheel set, and a third wheel is fixedly mounted to the intermediate wheel set. The third wheel of the intermediate wheel set actuates the star wheel, solely during the second step of the intermediate wheel. In this embodiment, each month only appears once on the month indicator disc and occupies an angular sector of one 12th of a revolution. Consequently, the display is larger than in the preceding embodiment. However, this advantage is offset by the fact that the mechanism includes additional parts that increase the thickness thereof.

Whichever embodiment is chosen, it is desirable to reduce the thickness of this type of calendar mechanism. Indeed, the calendar mechanism occupies a place, in a watchcase, between the movement and the dial. When the thickness of the calendar mechanism is large compared to that of the movement, the winding stem and the crown are shifted off-centre vertically on the side of the case, which is unattractive and inconvenient.

The present invention limits this drawback, by proposing a calendar mechanism of the type disclosed in EP Patent Application No. 04028561.1, but of reduced thickness.

More specifically, the invention concerns an annual calendar mechanism for a timepiece including:

- a date ring including a lug and 31 teeth, and a date wheel set arranged for rotating the date ring through one step once per day,
- an intermediate wheel set cooperating with the lug such that the date wheel set drives the intermediate wheel set through a first step when the date passes from the $30^{th}$ to the $31^{st}$, via the date ring,
- an annual wheel set meshed with the intermediate wheel set and cooperating with the date wheel set,
- the date, intermediate and annual wheel sets being arranged such that the date wheel set drives the intermediate wheel set through a second step when the date passes from the $31^{st}$ to the $1^{st}$ for months of 31 days, via the date ring, and so that the date wheel set drives the intermediate wheel set through a second step after the date has passed from the $30^{th}$ to $31^{st}$, for months of less than 31 days, via the annual wheel set, the intermediate wheel set then driving the date ring.

According to the invention, the mechanism further includes a month indicator ring including an inner flank fitted with teeth cooperating with the intermediate wheel set, the intermediate wheel set being arranged to rotate the date ring at least through a second step.

Owing to these features, the thickness of the calendar mechanism according to the invention is reduced, to a minimum, by the thickness of the month indicator disc.

BRIEF DESCRIPTION OF THE DRAWINGS

Other features and advantages of the present invention will appear more clearly from the following detailed description of an example embodiment of a calendar mechanism according to the invention, this example being given by purely by way of non-limiting illustration, with reference to the annexed drawing, in which.

DETAILED DESCRIPTION OF THE ILLUSTRATIVE EMBODIMENTS

Figure 1:
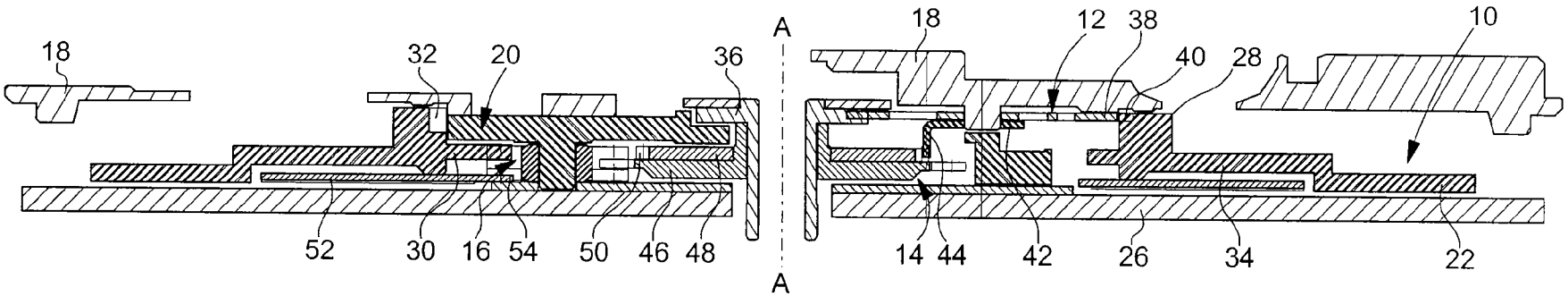
FIGS. 1 and 8 are cross-sections along an axis XX of first and second embodiments of the calendar mechanism according to the invention.

The calendar mechanism shown in FIG. 1, conventionally comprises a date ring 10 of axis AA, a date wheel set 12 for driving date ring 10, an annual wheel set 14 coaxial to the date ring 10 and an intermediate wheel 16, together forming two kinematic chains whose origin is the date wheel set 12. The assembly is mounted on the top face of a plate 18, provided with a bridge 20.

The date ring 10 is angularly positioned by a jumper spring that is not shown, mounted on bridge 20. It conventionally includes an annular portion bearing the date markings visible through an aperture 24 made in a dial 26. It further includes, a substantially cylindrical portion 28 fitted with a lug 30 in a top stage, and 31 teeth 32, corresponding to the 31 days of the month, in a bottom stage. The annular 22 and cylindrical portions 28 are rigidly connected to each by a substantially annular intermediate portion 34 forming a with annular portion 22. The function of intermediate portion 34 will be better understood in the following description.

Date ring 10 is driven once per day through one step, by date wheel set 12. The latter completes one revolution in 24 hours, and draws the drive force acting thereon from a kinematic chain driven by a movement belonging to a timepiece, the last link of which is formed by an hour wheel 36. It includes a toothed wheel 38, one of whose teeth, longer than the others, forms a beak 40 cooperating with teeth 32. The date wheel set further includes an additional part 42 fitted with a finger 44 cooperating with the annual wheel set 14 so as to drive the latter through one step at the end of each month comprising less than 31 days.

The annual wheel set 14 is formed of an annual wheel 46 with 24 teeth, secured to a circular plate 48 comprising 5 lugs 50 corresponding to the five months of less than 31 days. The lugs 50 are angularly distributed around plate 48 so as to reflect the distribution of the months of less than 31 days in the year. The annual wheel set 14 is driven by the date wheel set 12, using lugs 50, when one of them is on the trajectory of finger 44, as explained hereinafter.

Intermediate wheel 16 is meshed with annual wheel 46. Moreover, it is arranged on the path of lug 30 so as to cooperate in two steps with the latter when the date passes from the $30^{th}$ to the $31^{st}$ and then from $31^{st}$ to the $1^{st}$. It includes alternately thick teeth and thin teeth, the latter being identified by a dot in FIGS. 2 to 7. It may be manufactured in metal by machining, or in plastic material, by injection moulding, in order to reduce the cost. It will be noted that as an alternative to the single-piece intermediate wheel 16, one could use an intermediate wheel set formed of a first comprising an even number of teeth and a second wheel secured to the first wheel and comprising half as many teeth.

The calendar mechanism further includes, according to the invention, a month indicator ring 52, on which the names of the twelve months of the year are marked, visible through aperture 24. Each month occupies, on ring 52, an angular sector of one $12^{th}$ of a revolution. Ring 52 is further fitted, on the inner flank thereof, with 12 teeth 54 directed towards the centre of symmetry thereof, for cooperating with intermediate wheel 16. It is mounted coaxially to date ring 10, can rotate freely, and extends above the intermediate portion 34 of date ring 10. Moreover, the arrangement of ring 52 and intermediate wheel 16 is such that only the thick teeth can cooperate with teeth 54 of indicator ring 52. The thin teeth pass underneath teeth 54 without driving said ring. Like date ring 10, month indicator ring 52 is positioned angularly by a jumper spring that is not shown, mounted on bridge 20. It will be noted, as is visible in FIG. 1, that as month indicator ring 52 is arranged above the intermediate portion 34 of date ring 10, substantially in the same plane as annular portion 22, it does not create an excessive thickness with the various wheel sets. Moreover, owing to this arrangement, the star wheel and the third wheel of the intermediate wheel set present in EP Patent Application No 04028561.1 are omitted. This results in a considerable saving in thickness and complexity.

It will be noted that date wheel set 12 forms with date ring 10, intermediate wheel 16 and annual wheel set 14 a first kinematic chain I, starting from date wheel set 12 and ending with annual wheel set 14, via date ring 10 and intermediate wheel 16, and a second kinematic chain II starting from date wheel set 12 and ending with date ring 10 via annual wheel set 14 and intermediate wheel 16.

The date mechanism previously described is to be fitted to a mechanical or electromechanical watch powered by an electric energy source. The operation thereof will be described in detail with reference to FIGS. 2 to 4, then 5 to 7, illustrating the passage of the date from the $30^{th}$ to the $1^{st}$ respectively for a month of less than 31 days, then for a month of 31 days.

Figure 2:
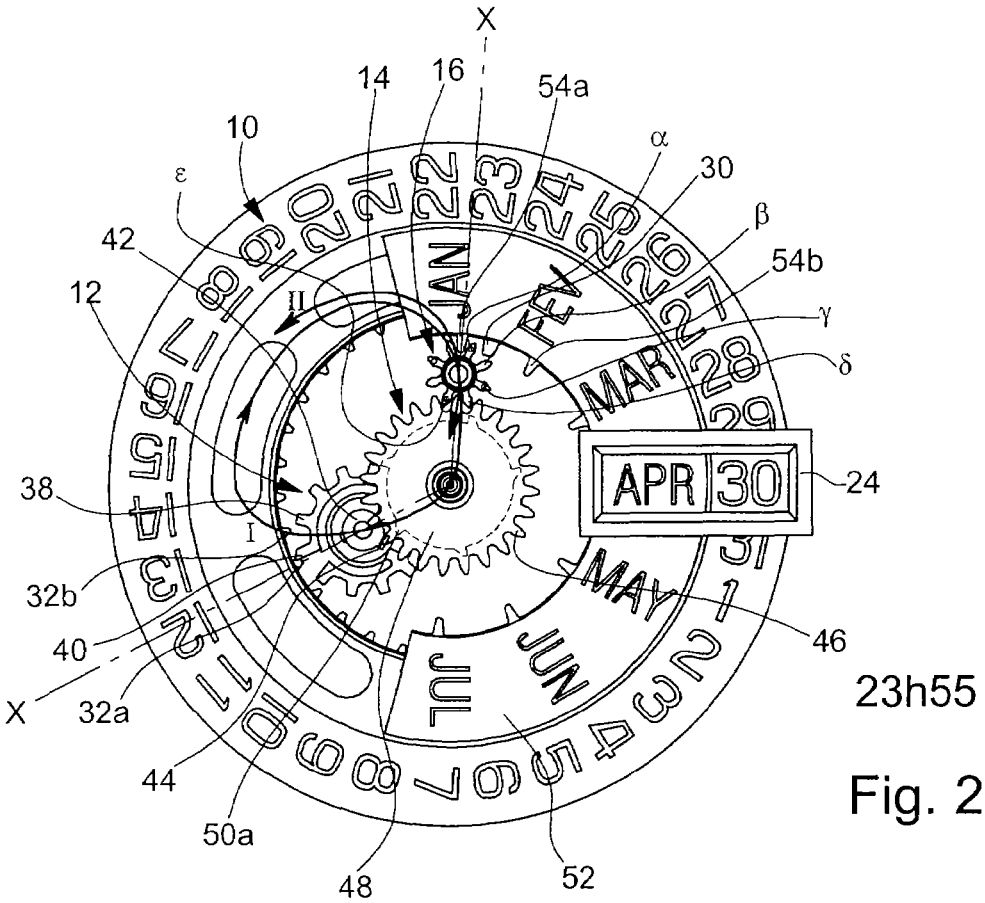
FIGS. 2 to 7 and 9 to 14 are top views illustrating various operating steps of said mechanism respectively according to a first and a second embodiment.

FIG. 2 illustrates the situation of the date mechanism according to the invention on $30^{th}$ April at 23h55. The date displayed is the $30^{th}$ April. Beak 40 of date wheel set 12 comes into contact with one tooth 32*a* of date ring 10 which it prepares to drive through one step. Lug 30 of date ring 10 is located in immediate proximity to intermediate wheel 16, which it prepares to drive through one step. One tooth 54*a* of month indicator ring 52 is meshed with intermediate wheel 16, such that the next active tooth of intermediate wheel 16, is a thin tooth referenced $\alpha$. The following teeth of the intermediate wheel 16 are referenced $\beta$, $\gamma$, $\delta$ and $\epsilon$.

Figure 3:
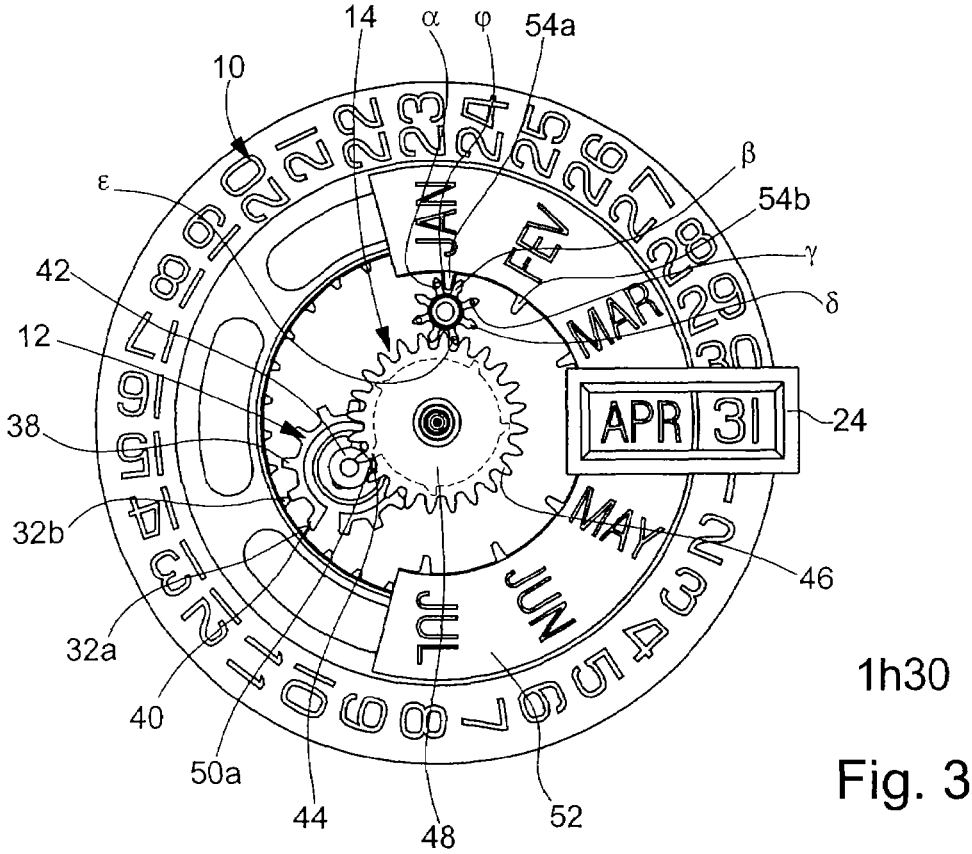

FIG. 3 illustrates the situation of the mechanism on $1^{st}$ May at 01h30. Via the action of date wheel set 12, date wheel 10 has rotated one step. Lug 30 of date ring 10 has driven intermediate wheel 16 through one step, and intermediate wheel 16 has driven annual wheel set 14 through one step. A lug 50*a* is now located on the trajectory of finger 44, such that annual wheel set 14 is ready to be driven through a second step by date wheel set 12. Intermediate wheel 16 has not, however, driven month indicator ring 42, since the thin tooth $\alpha$ has passed underneath tooth 54*a*. The date displayed is thus provisionally the $31^{st}$ April. Tooth 54*a* is still meshed with intermediate wheel 16, but the first active tooth is a thick tooth referenced $\beta$. It will be noted that during this first date change phase, it is kinematic chain I that has been used.

Figure 4:
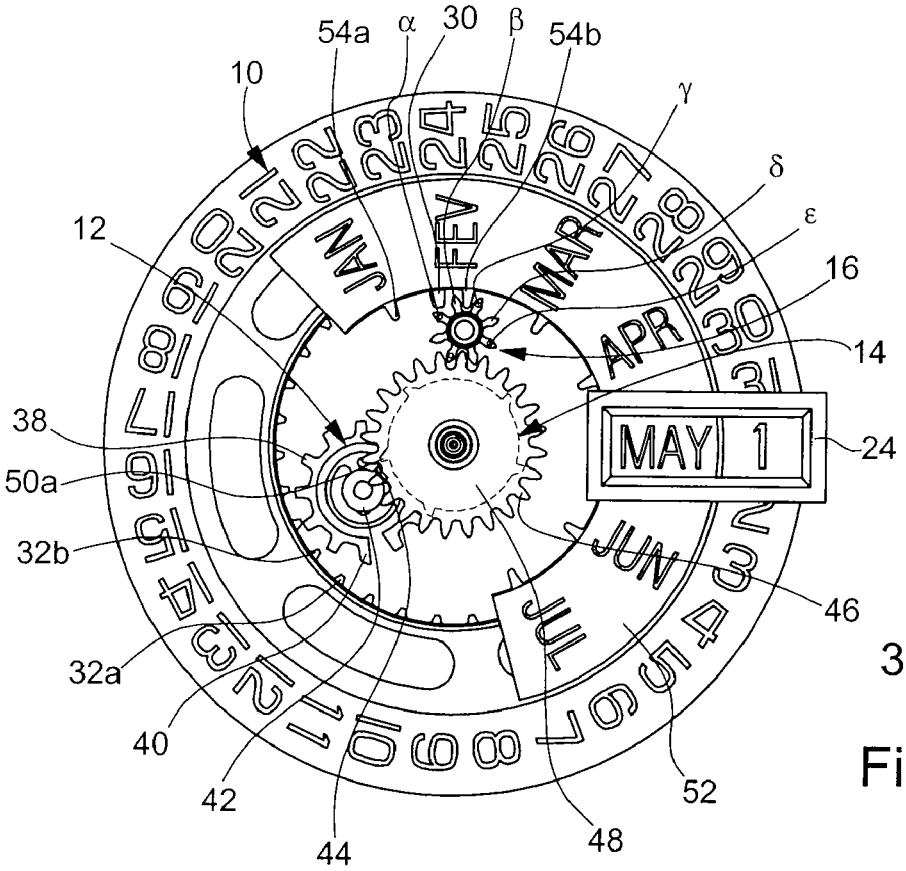

Reference will now be made to FIG. 4, which illustrates the situation of the mechanism on the $1^{st}$ May at 03h00. Finger 44 has driven annual wheel set 14 through a second step, and the latter has itself driven intermediate wheel 16 through a second step. The latter has driven date ring 10 via lug 30, and the month indicator ring via tooth 54*a*, using thick tooth $\beta$. Lug 30 is released, and the date displayed is the $1^{st}$ of May. A tooth 54*b* is now meshed with intermediate wheel 16. During this second date change phase, it is kinematic chain II that is used.

Figure 5:
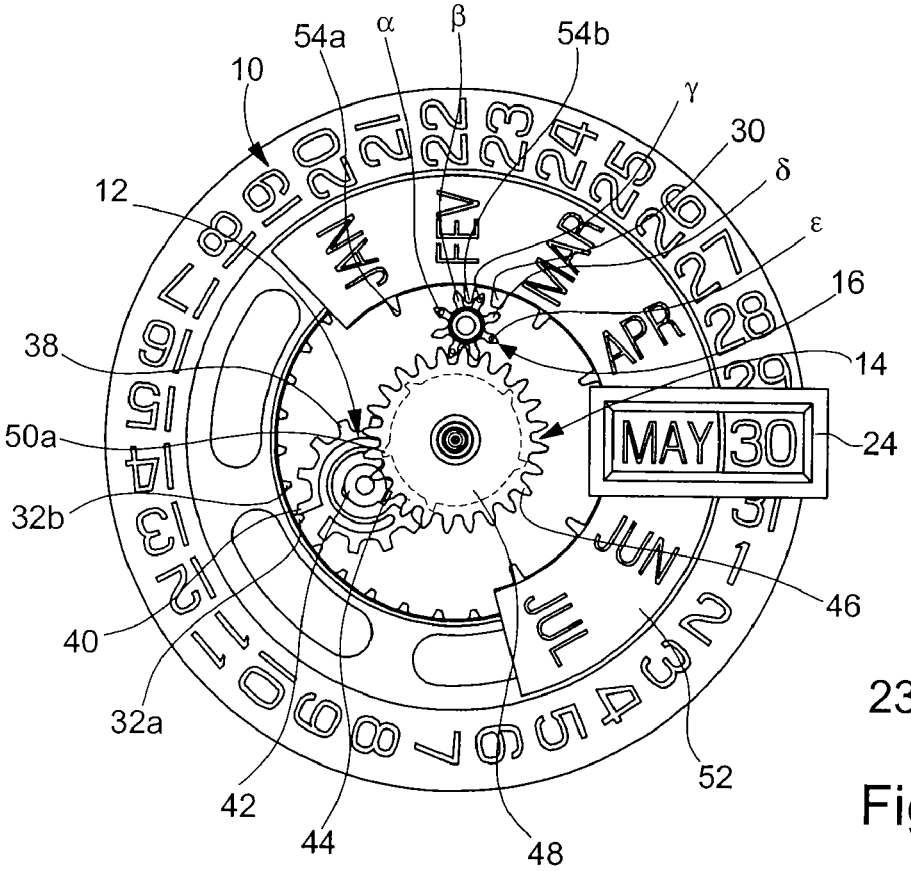

FIG. 5 illustrates the situation of the date mechanism on the $30^{th}$ May at 23h55. The date displayed is the $30^{th}$ May. Beak 40 of date wheel set 12 comes into contact with tooth 32*a* of date ring 10 which it prepares to drive through one step. Lug 30 of date ring 10 is situated in immediate proximity to intermediate wheel 16, which it prepares to driven through one step. Tooth 54*b* of month indicator ring 52 is meshed with intermediate wheel 16, such that the next active tooth of intermediate wheel 16 is a thin tooth referenced γ. It will be noted that the positions of annual wheel set 14, intermediate wheel 16 and month indicator ring 52 remain unchanged since the 1st May at 03h00.

Figure 6:
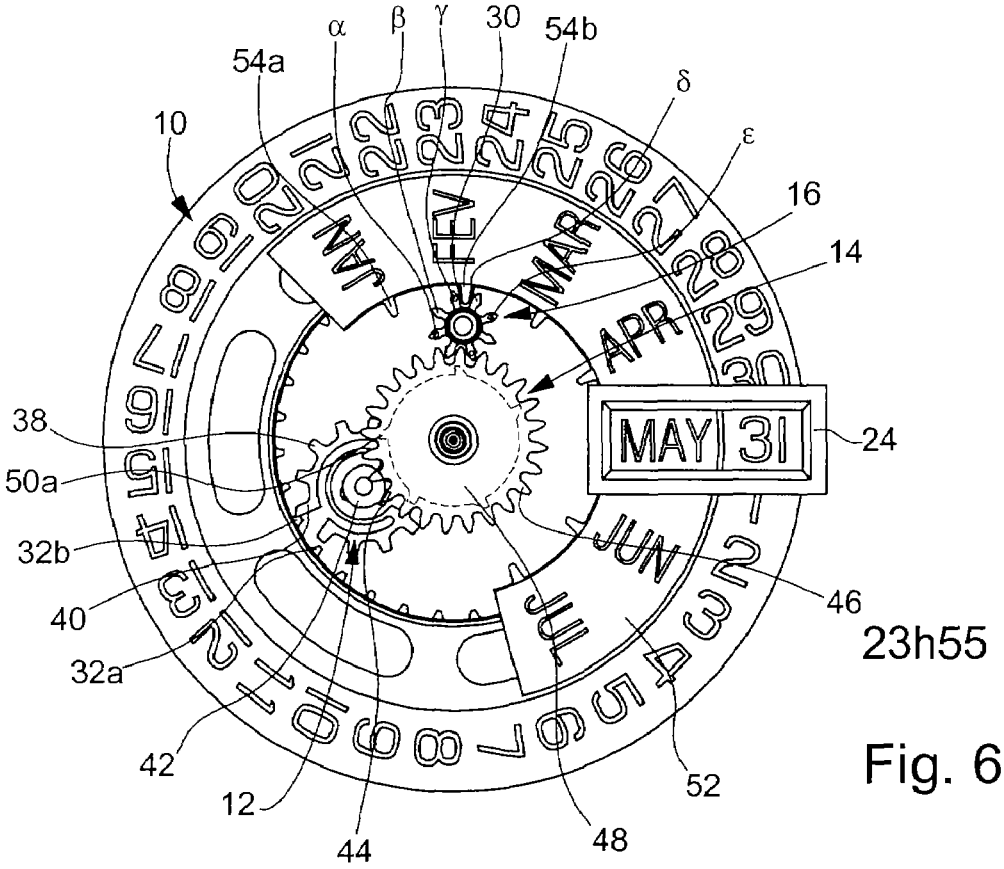

FIG. 6 illustrates the situation of the mechanism on The 31st May at 23h55. Via the action of date wheel set 12, date ring 10 has rotated one step. Lug 30 of date ring 10*h* has driven intermediate wheel 16 through a first step. The latter has not driven month indicator ring 42, since the thin tooth γ has passed underneath tooth 54*b* meshed with intermediate wheel 16. The date displayed is thus the 31st May. Tooth 54*b* is still meshed with intermediate wheel 16, but the next active tooth is a thick tooth referenced δ. Intermediate wheel 16 has, however, driven annual wheel set 14 through a first step, but no lug 50 was on the path of finger 44, such that date wheel set 12 completed a revolution without driving annual wheel set 14 through a second step. Beak 40 of date wheel set 12 now comes into contact with a tooth 32*b* of date ring 10. it will be noted that during this first date change phase, it is kinematic chain I that has been used.

Figure 7:
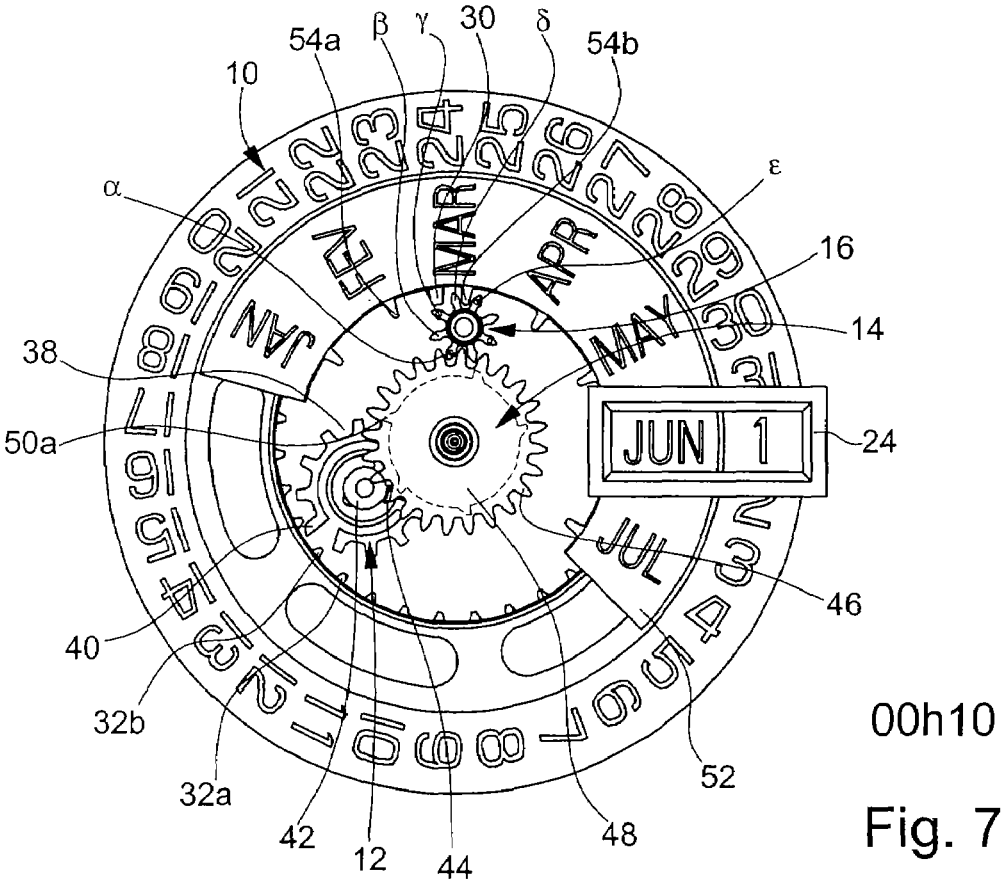

Reference will now be made to FIG. 7, which illustrates the situation of the calendar mechanism on the 1st June at 0h10. Via the action of the date wheel set 12, date ring 10 has rotated one step. Lug 30 of date ring 10 has driven intermediate wheel 16 through a second step. This latter has driven month indicator ring 42 via tooth 54*b*, using thick tooth δ. The date displayed is thus the 1st of June. One tooth 54*c* is now meshed with intermediate wheel 16, and the next active tooth is a thin tooth referenced ϵ. Intermediate wheel 16 has, however, driven annual wheel set 14 through a second step, but lug 50 is not on the path of finger 44. During this second date change phase, it is the same kinematic chain I that is used.

Figure 8:
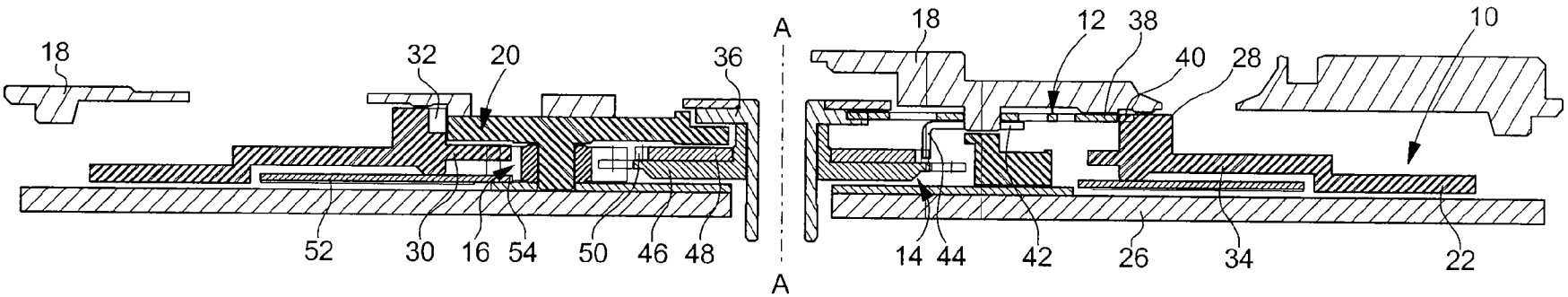

Reference will now be made to FIG. 8, which shows a variant of the calendar mechanism according to the invention. The mechanism illustrated in FIG. 8 differs from the mechanism previously described in that it comprises an intermediate wheel 56 that has only teeth of the same thickness, and in that the month indicator ring 52 includes 24 teeth 54, each of the twelve months being affixed twice. In this embodiment, each of the teeth of intermediate wheel 56 cooperates with the 24 teeth 54 of ring 52, for each step taken by intermediate wheel 56. This embodiment simplifies manufacture of intermediate wheel 56, since alternating thick teeth and thin teeth is complex and expensive compared to a single tooth thickness.

The operation of this variant of the calendar mechanism, illustrated in FIGS. 9 to 14, differs from the operation of the preceding mechanism, in that intermediate wheel 56 drives month indicator ring 52 at each step.

Figure 9:
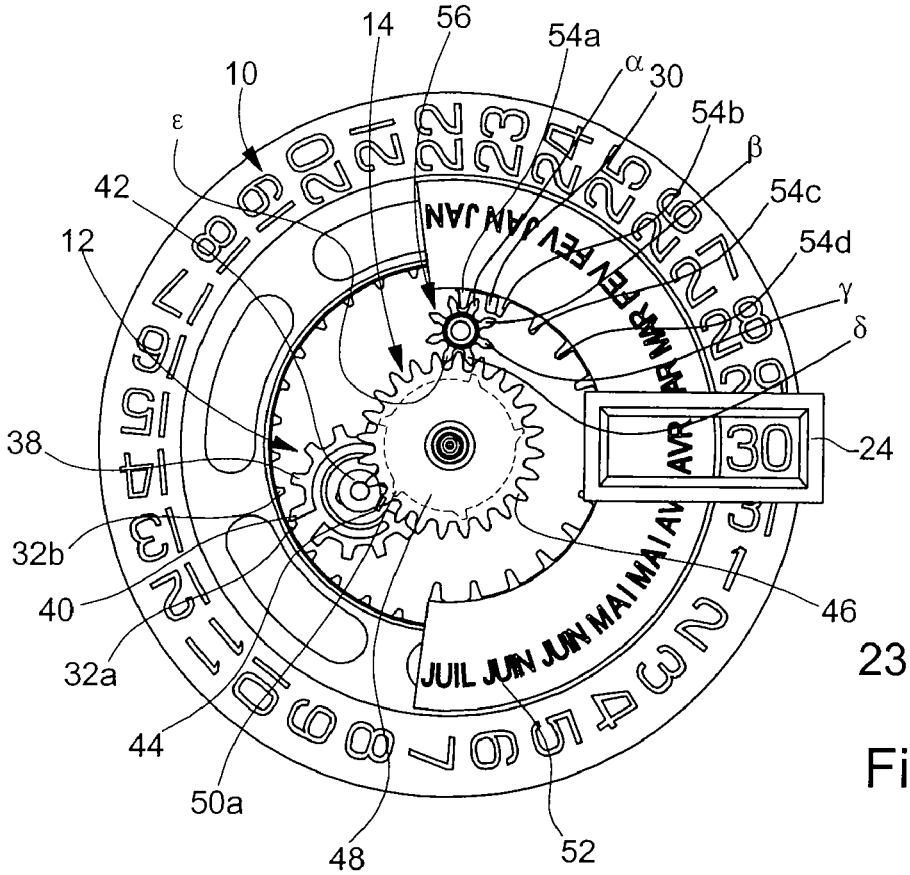

FIG. 9 illustrates the situation of this variant of the calendar mechanism according to the invention on the 30th April at 23h55. The date displayed is the 30th April, the first marking of the month of April being visible through aperture 24. The general configuration of the mechanism is similar to the configuration illustrated in FIG. 2, except that one tooth 54*a* of month indicator ring 52 is meshed with intermediate wheel 56, whose teeth are all of the same thickness.

Figure 10:
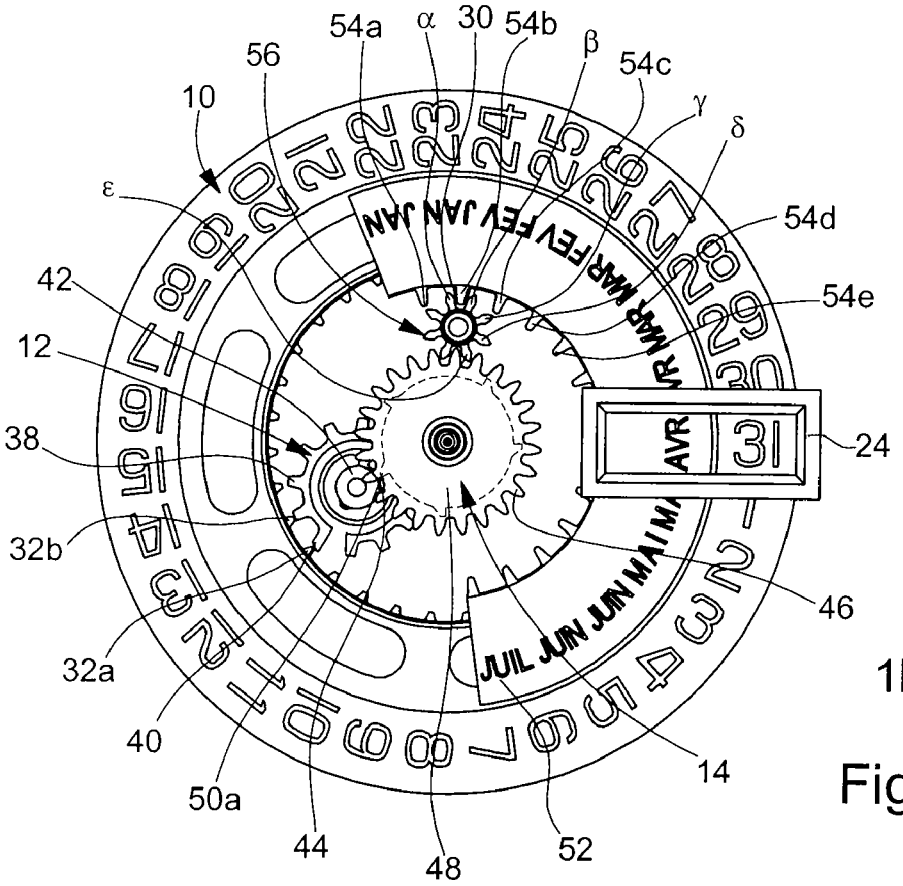

The situation of the mechanism on the 1st May at 01h30 is illustrated in FIG. 10. The kinematic chain I has been used and the various wheels sets have rotated through one step. The situation is similar to the situation illustrated in FIG. 3, except that the tooth a has driven month indicator ring 52 through one step. The date displayed is the 31st April, but it now the second marking of the month of April that is visible through aperture 24. A tooth 54*b* is now meshed with intermediate wheel 56.

Figure 11:
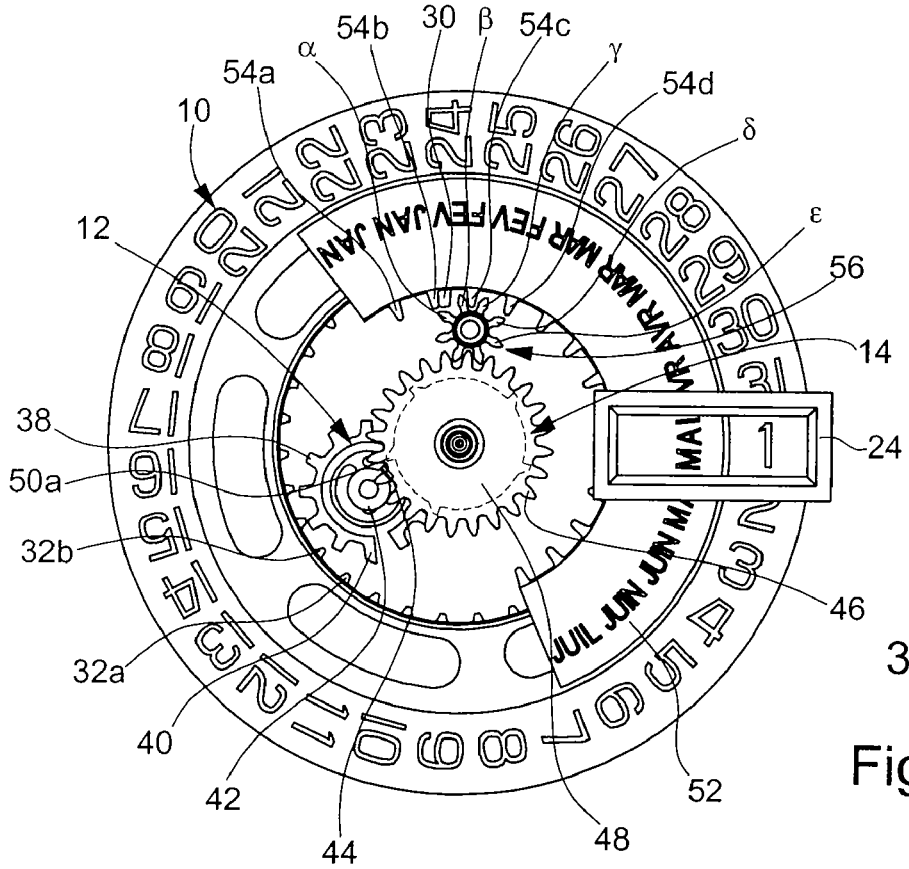

Reference will now be made to FIG. 11, which illustrates the situation of the calendar mechanism on the 1st May at 03h00. The kinematic chain II has been used and the various wheel sets have again rotated through one step. The date displayed is the 1st May, and a tooth 54*c* is now meshed with intermediate wheel 56.

Figure 12:
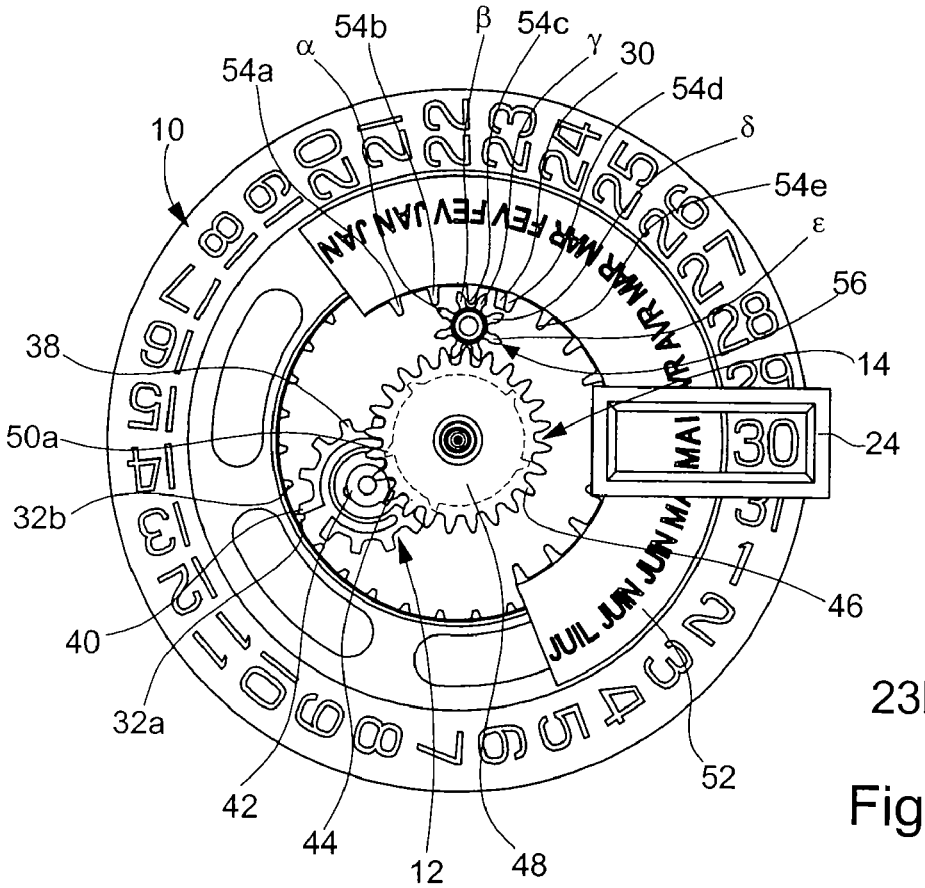

FIG. 12 illustrates the situation of the calendar mechanism on the 30th May at 23h55. The date displayed is the 30th May, the first marking of the month of May being visible through aperture 24. The general configuration of the mechanism is similar to the configuration illustrated in FIG. 5, except that one tooth 54*c* of month indicator ring 52 is meshed with intermediate wheel 56. It will be noted that the positions of annual wheel set 14, intermediate wheel 56 and month indicator ring 52 remain unchanged since the 1st of May at 03h00.

Figure 13:
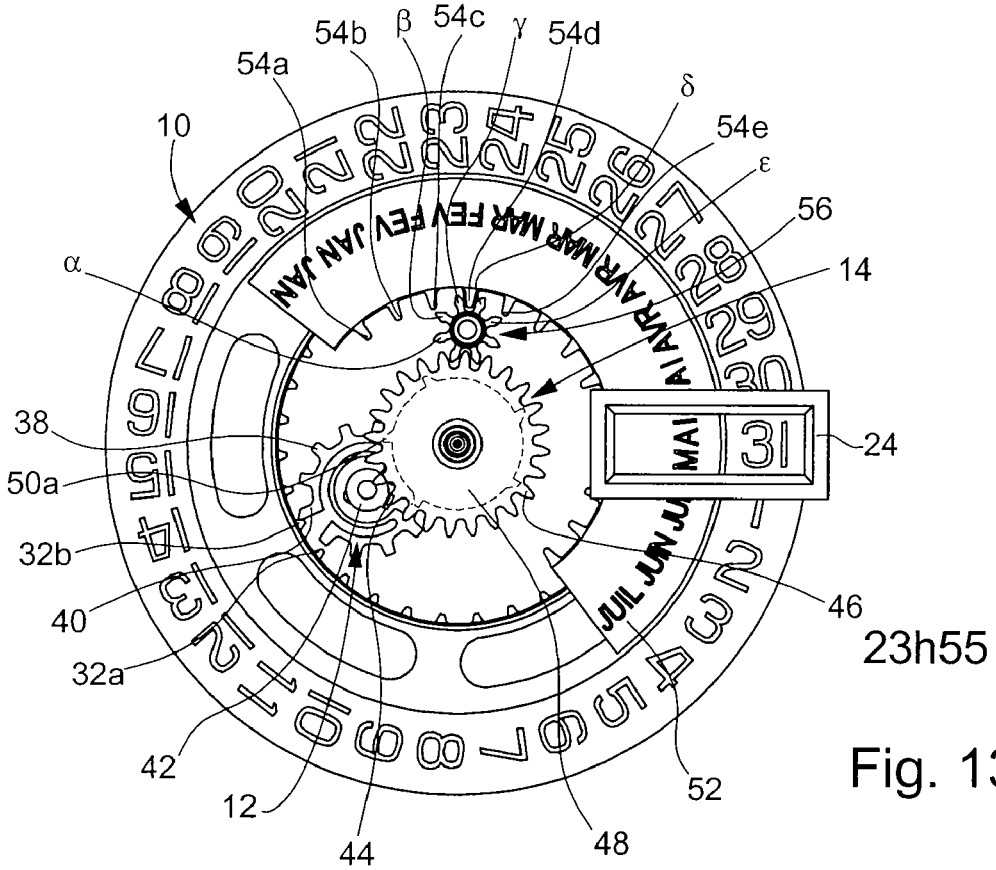

The situation of the mechanism on 31st May at 23h55 is illustrated in FIG. 13. Kinematic chain II has been used and the various wheel sets have rotated through one step. The situation is similar to the situation illustrated in FIG. 6, except that the tooth γ has driven month indicator ring 52 through one step. The date displayed is the 31st May, but it is now the second marking of the month of May that is visible through aperture 24. A tooth 54*d* is now meshed with intermediate wheel 56.

Figure 14:
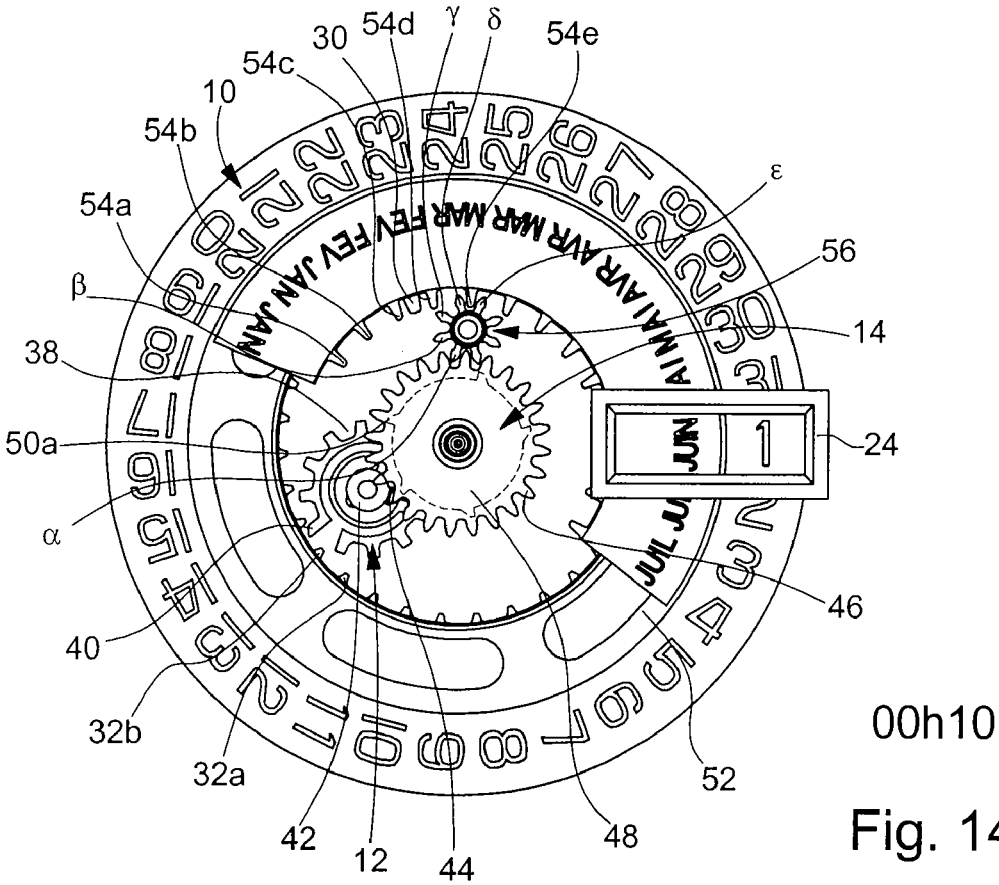

Reference will now be made to FIG. 14, which illustrates the situation of the calendar mechanism on the 1st June at 01h10. Kinematic chain I has been used a second time and the various wheel sets have again rotated through one step. The date displayed is the 1st June and a tooth 54*e* is now meshed with intermediate wheel 56.

Thus, an annual calendar mechanism, whose space requirement and complexity are reduced compared to the prior art has been presented.

It goes without saying that the present invention is not limited to the embodiments that have just been described and that various simple alterations and variants can be envisaged by those skilled in the art without departing from the scope of the invention defined by the annexed claims. It will be noted, in particular, that the mechanisms according to the invention are described at precise times. These times are given by way of indication and in no way limit the scope of protection.

What is claimed is:

1. An annual calendar mechanism for a timepiece, including:

a date ring including a lug and 31 teeth, and a date wheel set arranged for rotating said date ring through one step per day, an intermediate wheel set cooperating with said lug such that said date wheel set drives the intermediate wheel set through a first step when the date passes from the 30th to the 31st of the month, via said date ring, an annual wheel set meshed with the intermediate wheel set and cooperating with the date wheel set, said date, intermediate and annual wheel sets being arranged such that said date wheel set drives said intermediate wheel set through a second step when the date passes from the 31st to the 1st of the month, for the months of 31 days, via said date ring, and such that said date wheel set drives said intermediate wheel set through a second step after the date has passed from the 30th to the 31st of the month, for the months of less than 31 days, via the annual wheel set, the intermediate wheel set then driving the date wheel ring, said mechanism being wherein it further includes a month indicator ring including an inner flank fitted with teeth cooperating with said intermediate wheel set, said intermediate wheel set being arranged for rotating the month ring at least to said second step.

2. The mechanism according to claim 1, wherein said date ring includes an annular portion bearing the markings of the days of the month, and wherein said month indicator ring is arranged in substantially the same plane as said annular portion.

3. The mechanism according to claim 2, wherein said date ring further includes a substantially annular intermediate portion forming a step with said annular portion and wherein said month indicator ring extends above said intermediate portion.

4. The mechanism according to claim 1, wherein said intermediate wheel set is formed of a wheel including alternating thick teeth and thin teeth and is arranged such that only the thick teeth cooperate with the teeth of said month indicator ring.

5. The mechanism according to claim 4, wherein said month indicator ring includes 12 teeth and wherein each month is affixed only once.

6. The mechanism according to claim 1, wherein said intermediate wheel set is formed of a wheel whose teeth are all of the same thickness.

7. The mechanism according to claim 6, wherein said month indictor ring includes 24 teeth and wherein each month is affixed twice.

* * * * *